US006016469A

United States Patent [19]

Laurent

[11] Patent Number: 6,016,469

[45] Date of Patent: Jan. 18, 2000

[54] PROCESS FOR THE VECTOR QUANTIZATION OF LOW BIT RATE VOCODERS

[75] Inventor: Pierre André Laurent, Bessancourt, France

[73] Assignee: Thomson -CSF, Paris, France

[21] Appl. No.: 09/029,254

[22] PCT Filed: Sep. 4, 1996

[86] PCT No.: PCT/FR96/01347

§ 371 Date: Mar. 5, 1998

§ 102(e) Date: Mar. 5, 1998

[87] PCT Pub. No.: WO97/09711

PCT Pub. Date: Mar. 13, 1997

[30] Foreign Application Priority Data

Sep. 5, 1995 [FR] France ..... 95 10393

[51] Int. Cl.[7] ..... G10L 7/02

[52] U.S. Cl. ..... 704/222; 704/230

[58] Field of Search ..... 704/222, 230, 704/203, 204, 219, 261, 262, 266, 269, 243, 245

[56] References Cited

U.S. PATENT DOCUMENTS

| | | | |
|---|---|---|---|
| 4,027,261 | 5/1977 | Laurent et al. | 327/98 |
| 4,382,232 | 5/1983 | Laurent | 329/303 |
| 4,603,393 | 7/1986 | Laurent et al. | 329/306 |
| 4,799,241 | 1/1989 | Laurent | 375/364 |
| 4,852,098 | 7/1989 | Brechard et al. | 371/37.08 |
| 4,888,778 | 12/1989 | Brechard et al. | 371/37.4 |
| 4,905,256 | 2/1990 | Laurent | 375/275 |
| 4,907,276 | 3/1990 | Aldersberg | 704/222 |
| 4,945,312 | 7/1990 | Auger et al. | 329/345 |
| 4,982,341 | 1/1991 | Laurent | 704/250 |
| 5,016,278 | 5/1991 | Rochette et al. | 704/211 |
| 5,243,685 | 9/1993 | Laurent | 704/200 |
| 5,313,553 | 5/1994 | Laurent | 704/207 |
| 5,455,892 | 10/1995 | Minot et al. | 706/25 |
| 5,522,009 | 5/1996 | Laurent | 704/221 |
| 5,555,320 | 9/1996 | Irie et al. | 704/232 |
| 5,568,591 | 10/1996 | Minot et al. | 706/25 |
| 5,715,367 | 2/1998 | Gillick et al. | 704/254 |
| 5,826,224 | 10/1998 | Gerson et al. | 704/222 |

FOREIGN PATENT DOCUMENTS 0 504 485 A2 9/1992 European Pat. Off. .

OTHER PUBLICATIONS

Fischer et al., "Transform Coding of Speech with Pyramid Vector Quntization," 1985 IEEE Military Communications Conference, Oct. 20 to 23, 1985, pp. 620–623.

*Primary Examiner*—David R. Hudspeth
*Assistant Examiner*—Martin Lerner
*Attorney, Agent, or Firm*—Oblon, Spivak, McClelland, Maier & Neustadt, P.C.

[57] ABSTRACT

A process for the vector quantization of low bit rate vocoders, including determining a coding region by surrounding with an envelope a scatter of points of an autocorrelation matrix of reflection coefficients of a filter configured to model a vocal tract, wherein the envelope has a shape selected from the group consisting of a hyperellipsoid shape and a pyramidal shape, the envelope being centered at the barycenter of the scatter of points; determining principal axes of the volume of points inside the envelope; projecting area coefficients of the autocorrelation matrix onto the principal axes; partitioning the interior volume of the envelope into elementary volumes; and coding partition coefficients resulting from partitioning the interior volume on the basis of coordinates of said partition coefficients in a space defined by the principal axes of the volume of the points inside the envelope, while allocating as code values only values corresponding to locations of the elementary volumes in which said partition coefficients lie.

20 Claims, 3 Drawing Sheets

PROCESS FOR THE VECTOR QUANTIZATION OF LOW BIT RATE VOCODERS

BACKGROUND OF THE INVENTION

1. Field of the Invention

The present invention relates to a process for the vector quantization of low bit rate vocoders.

It applies in particular to linear-prediction vocoders similar to those described for example in the THOMSON-CSF Technical Journal, Volume 14. No. 3, Sep. 1982, pages 715 to 731, and according to which the speech signal is identified at the output of a digital filter whose input receives, either a periodic waveform corresponding to those of the voiced sounds, viz. vowels, or to a random waveform corresponding to those of the unvoiced sounds, viz. the majority of consonants.

2. Discussion of the Background

It is known that the auditory quality of linear-prediction vocoders depends in large part on the accuracy with which their predictive filter is quantized and that this quality generally decreases as the digital bit rate between vocoders decreases since the accuracy of quantization of the filter then becomes insufficient. Numerous quantization processes of the type of those described for example in Patent Application EP 0504485 A2 or in U.S. Pat. No. 4,907,276 have been developed in order to solve this problem. In general, the speech signal is segmented into independent frames of constant duration and the filter is renewed at each frame. Thus, to arrive at a bit rate of around 1820 bits per second, the filter must, according to a standard implementation, be represented by a packet of 41 bits transmitted every 22.5 milliseconds. For non-standard links with a lower bit rate, of the order of 800 bits per second, fewer than 800 bits per second have to be transmitted in order to represent the filter, this constituting a bit rate ratio of approximately 3 as compared with standard implementations. 30 bits on average are used to quantize one filter out of two, and these 30 bits are composed of 3 bits defining a quantization scheme and 27 bits for quantizing 10 quantities obtained from LAR (Log Area Ratio) coefficients by displacement and rotation in the 10-dimensional space thus defined. As a result the quantization now begins to be only approximately transparent, and auditory compensation of this artefact is necessary, by coarse quantization of the filters located in the transitions of the speech signal and fine quantization of those corresponding to stable zones. To obtain sufficient accuracy of quantization of the predictive filter despite everything, the conventional approach consists in employing a vector quantization scheme which is intrinsically more efficient than that used in standard systems where the 41 bits employed serve for the scalar quantization of the P=10 coefficients of their prediction filter. The method relies on using a dictionary containing a specified number of standard filters obtained by learning. It consists in transmitting only the page or the index at which the standard filter rate which is obtained, only 10 to 15 bits per filter being transmitted instead of the 41 bits required in scalar quantization mode, however this bit rate reduction is obtained at the cost of a very large increase in the memory size required to store the elements of the dictionary and of a considerable computational burden attributable to the complexity of the filter search algorithm.

By applying this approach also to low bit rate vocoders of 800 bits/s and less, it is commonly supposed that 24 bits are sufficient for a composite dictionary produced from two dictionaries with 4,096 elements accounting for the first four and last six LSPs respectively. The major drawback of this type of quantization again resides in the need to compile this dictionary, to store it and to perform the quantization proper.

Alternatives to the vector quantization scheme have also been proposed in order to reduce the number of elements stored in the dictionary. Thus, a technique of pyramidal vector quantization is in particular known, a description of which may be found in the journal IEEE trans. on INFTH Vol. IT 32 No. 4, July 1986, pages 568 to 582 by Thomas R. Fischer entitled "A pyramid vector quantizer". According to this technique the multidimensional input data are distributed over the vertices of a regular grid included within a pyramid of multiple dimension. This quantization technique is applied mainly in respect of data with a Laplacian distribution characteristic. However, the reduction in bit rate which results from this is not always sufficiently appreciable. This is due in particular to the fact that in practice the overall shape of the multidimensional data to be processed is in actual fact inscribed within an ellipsoid, especially when using a prediction/extrapolation computation system which always involves a Gaussian characteristic shape of data. Moreover, the pyramid which is inscribed on this ellipsoid leads to the coding of the points which lie outside the ellipsoid surrounding the scatter of points to be coded, thereby making it necessary to dimension code words with a number of bits which exceeds what is strictly necessary.

SUMMARY OF THE INVENTION

The objective of the invention is to overcome the aforementioned drawbacks.

To this end, the subject of the invention is a process for the vector quantization of low bit rate vocoders, characterized in that it consists in determining the coding region by surrounding with an envelope the scatter of the points of the auto-correlation matrix of the reflection coefficients of the filter for modelling the vocal tract, in determining the principal axes of the volume of points inside the envelope, in projecting the coefficients of the autocorrelation matrix onto the principal axes, in partitioning the interior volume of the envelope into elementary volumes and in coding the coefficients resulting from the projection on the basis of their coordinates in the space defined by the principal axes of the volume of the points inside the envelope, while allocating as code values only those values corresponding to the locations of the elementary volumes in which they lie.

The main advantage of the invention is that it employs a prediction filter quantization process which requires virtually no more binary elements to quantize the points representing the prediction filters than a dictionary-based vector quantization process, whilst remaining simple and fast to implement and occupying only a small memory space.

BRIEF DESCRIPTION OF THE DRAWINGS

Other characteristics and advantages of the invention will emerge below with the aid of the description which follows with regard to the figures of the appended drawings which represent.

DISCUSSION OF THE PREFERRED EMBODIMENTS

The coding process according to the invention consists, after having partitioned the speech signal into frames of constant length of around 20 to 25 ms, as is customarily the case in vocoders, in determining and coding the characteristics of the speech signal on successive frames by determining the energy of the signal P times per frame.

The synthesis of the speech signal on each frame is then carried out by deframing and decoding the values of the coded characteristics of the speech signal.

Figure 1:
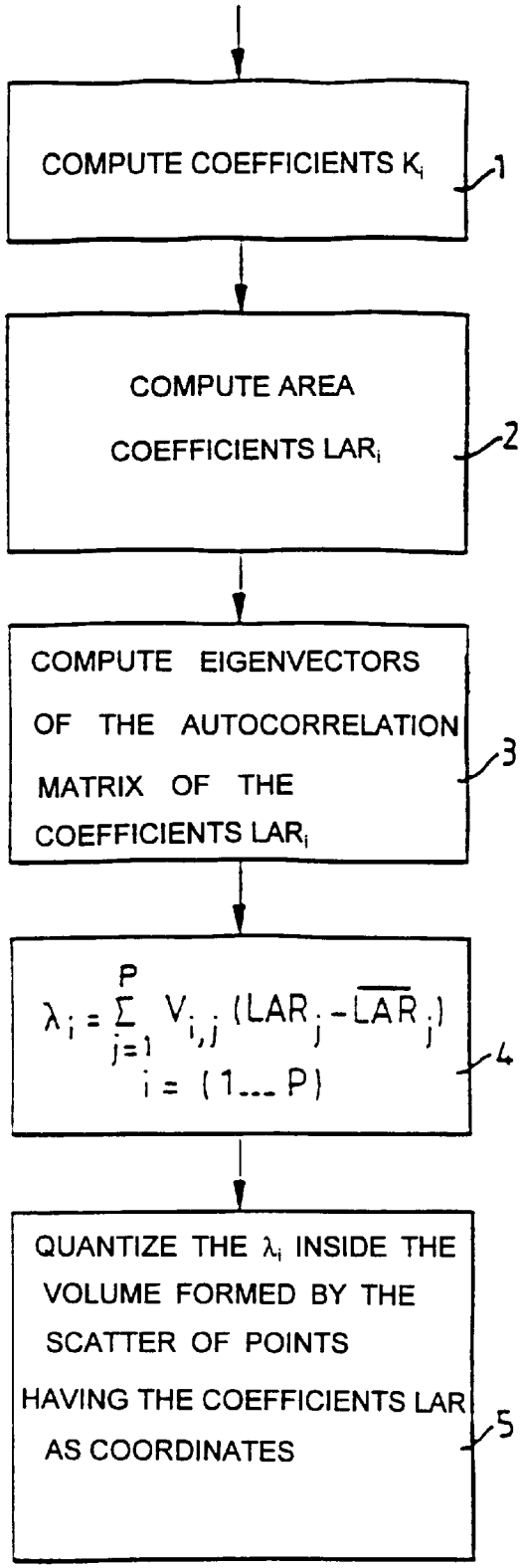
FIG. 1 a flow chart illustrating the speech coding process employed by the invention.

The representative steps of the coding process according to the invention which are represented in FIG. 1 consist in computing in step 1, after a step (not represented) of sampling the speech signal $S_K$ on each frame and quantizing the samples over a specified number of bits followed by a pre-emphasizing of these samples, the coefficients $K_i$ of a filter for modelling the vocal tract on the basis of autocorrelation coefficients $R_i$ of the samples $S_K$ according to a relation of the form $$R_i = \sum_k S(k) \cdot S(k+i) \tag{1}$$

The coefficients $K_i$ are computed for example by applying the known algorithm by M. Leroux-Guegen, a description of which can be found in the article from the journal IEEE Transaction on Acoustics Speech, and Signal Processing, June 1977 entitled "A fixed point computation of partial correlation coefficients". This computation amounts to inverting a square matrix whose elements are the coefficients $R_i$ of relation (1).

Figure 2:
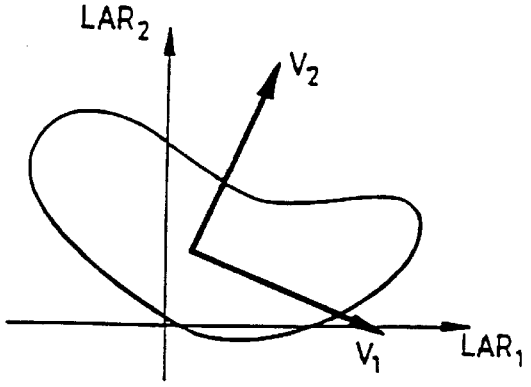
FIG. 2 a two-dimensional vector space depicting a distribution of area coefficients derived from the reflection coefficients modelling the vocal tract.

The next step 2 consists in non-linearly distorting the reflection coefficients by transforming them into area coefficients denoted $LAR_i$ from the abbreviation LOG AREA RATIO using the relation $$LAR_i = c^{te} \cdot \log\left(\frac{1+K_i}{1-K_i}\right) \qquad \text{with } i = (1 \ldots P) \tag{2}$$

so as in step 3 to compute the eigenvectors of an autocorrelation matrix of the coefficients $LAR_i$ which define in the P-dimensional space the favoured directions of a scatter of points whose coordinates are the coefficients $LAR_i$ with i=1–P. By way of example the scatter of points represented in FIG. 2 in a space with just two dimensions exhibits two favoured directions symbolized by the eigenvectors $V_1$ and $V_2$.

Returning to FIG. 1, step 4 consists in projecting the LAR coefficients onto the favoured directions by computing for example coefficients $\lambda_i$, representing the sum of the projections of the coefficients $(LAR_j\overline{LARj})$ onto the eigenvectors $V_i$ to $V_P$ of the autocorrelation matrix of the coefficients LAR, using the relation $$\lambda_i = \sum_{j=1}^{P} V_{i,j}(LAR_j - \overline{LARj}) \qquad \text{for } i = (1 \ldots p) \tag{3}$$

in which $V_{i,j}$ denotes the eigenvectors and $\overline{LAR_j}$ is the mean value of each coefficient $LAR_j$ of rank j.

Since each of the coefficients $\lambda_i$ moves between a minimum value $-\lambda_{imax}$ and a maximum value $+\lambda_{imax}$, this movement makes it possible to approximate the shape of the observed scatter of points by a hyperellipsoid, the values of the semi-major axes of which are represented by the coefficients $\lambda_{imax}$.

For each of the $\lambda_i$, a uniform quantization is then performed between a minimum value $\lambda_{imini}$ and a maximum value $\lambda_{imax}$ using a number of bits $n_i$ which is computed by the conventional means on the basis of the total number N of bits used to quantize the filter and the percentages of inertia corresponding to the eigenvectors $V_i$.

The coefficients $\lambda_i$ are quantized using a measure of distance between filters, the most natural of which is the weighted Euclidean distance of the form:

$$D(F_1, F_2) = \sum_{i=1}^{P} \gamma i(\lambda_{1,i} - \lambda_{2,i})^2 \tag{4}$$

in which the coefficients $\gamma_i$ are a decreasing function of their rank i and are fitted experimentally.

In an equivalent manner, given that the coefficients $\gamma_i$ are centred about the barycentre of the hyperellipsoid, the same result can also be achieved by using a purely Euclidean distance measure pertaining to the modified coefficients, such as $$D(F_1 F_2) = \sum_{i=1}^{P} (\mu_{1,i} - \mu_{2,i})^2 \quad \text{with } \mu_{K,i} = \lambda_{K,i}\sqrt{\gamma i} \tag{5}$$

The representative points of the filters with coordinates $\mu_i$ then lie inside a hyperellipsoid of dimension P, the P semi-major axes of which are respectively equal to $\mu_{imax}$ with $\mu_{imax}=\lambda_{imax}\ \gamma_i^{1/2}$.

Under these conditions if each of the coordinates $\mu_i$ were quantized uniformly between $-\mu_{imax}$ and $+\mu_{imax}$, the number of bits required would then be equal to the logarithm to the base 2 of the ratio between the quantizable parallelepipedal volume (slab) and the volume of an elementary hypercube according to the relation $$N_Q = \ln\left(\frac{\prod_{i=1}^{P}(2\mu_{imax})}{\Delta^P}\right) \Big/ \ln 2 \tag{6}$$

where Δ is the quantization interval. However, this definition leads to the representation not only of the points inside the ellipsoid but also a multitude of exterior points. For example, in dimension 3, this leads to the representation of twice as many points as necessary. This expansion in the number of points to be coded grows as the number of dimensions of the space to be considered increases.

Thus considering the volume of an ellipsoid defined for P even by the relation $$V_E = \frac{\pi^{\frac{P}{2}}}{\left(\frac{P}{2}\right)!}\prod_{i=1}^{P}\mu_{imax} \tag{7}$$

the number of bits $N_E$ strictly necessary is then given by $$N_E = \ln\left(\frac{V_E}{\Delta^P}\right)\Big/\ln 2 \tag{8}$$

thus giving $$N_E - N_Q = \ln\left(\frac{\pi\frac{P}{2}}{{}_2P\left(\frac{P}{2}\right)!}\right)\Big/\mathrm{Ln}2 \tag{9}$$

In the case of a prediction filter with P=10 coefficients this represents a difference of −8.65 bits and shows that in principle it is sufficient to use only 24 bits for $N_E$ instead of the 33 bits required to quantize the coefficients $\mu_i$ independently.

Under these conditions it appears that the only means of actually making a saving in the bits desired consists in forming a quantization in a space which is strictly limited inside the useful volume, of the ellipsoid of the points $\mu_i$. The invention achieves this by executing, in step 5, an algorithm which makes it possible unambiguously to enumerate all the points lying inside this volume.

For the convenience of the account, it will be assumed in what follows that the volume of the points is delimited by an envelope of ellipsoidal or pyramidal shape, but it will be appreciated that the coding process of the invention which is described also holds true for volumes of any envelope.

Assuming for simplicity that the space of the data to be quantized is a space of dimension 3 (N=3) and that all the points inside an ellipsoid with orthonormal axes 2X, 2Y, 2Z can be quantized using a quantization interval equal to one, the quantization process according to the invention applied to this space consists in associating a unique number with each set of integer coordinates x0, y0, z0 satisfying the relation:

$$\frac{x_0^2}{X^2} + \frac{y_0^2}{Y^2} + \frac{z_0^2}{Z^2} \le 1 \tag{10}$$

Figure 3:
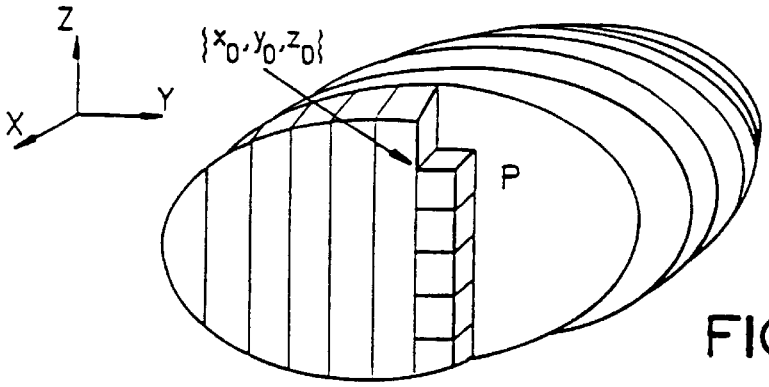
FIG. 3 an illustration of the coding process according to the invention in a three-dimensional space.

As FIG. 3 shows, this association is carried out in three steps. A first step consists in traversing the x axis and in computing the total number of points lying in the slices of the ellipsoid which are perpendicular thereto and which cut the x axis at points for which x takes the successive integer values −X, −X+1, . . . , x−2, x−1. The second step consists in traversing the y axis while adding to the previous result the sum of the numbers of points lying in the slices of the ellipsoid whose abscissa is equal to x and whose ordinate is equal in succession to −Y(x), −Y(x+1), . . . , y−2, y−1 where Y(x)≦Y and is the largest value for which the point with coordinates (x Y(x), 0) lies in the ellipsoid or its surface. Finally, according to the third step, the z axis is traversed while adding to the previous result the sum of the numbers of points lying in the slices whose abscissa is equal to x, whose ordinate is equal to y and whose altitude is equal successively to −Z(x,y), −Z(x,y)+1, . . . , z−2, z−1 where Z(x,y)≦Z and is the largest value for which the point with coordinates (x,y,Z(x,y) lies in the ellipsoid or its surface. The final result gives the exact number of points extending ahead of the point to be quantized, that is to say the points for which x or y or z is less than xo, yo or zo respectively. This principle can naturally be extended to spatial dimensions of any order. For a space of order N, the various volumes of dimensions 2, 3, . . . , N-1 are precomputed and stored in a read-only memory. By generalizing this principle to an ellipsoid with N dimensions, and denoting the dimensions of the semi-axes as $A_1$, $A_2$, . . . , $A_N$, the volume inside the ellipsoid is defined by the relation:

$$V_n = \int_{-A_N}^{A_N} dx_N \int_{-\alpha_{N-1}}^{+\alpha_{N-1}} \int_{A_{N-1}}^{A_{N-1}} dX_{N-1} \ldots \int_{-\alpha_1 A_1}^{+\alpha_1 A_1} dX_1 \tag{11}$$

with $\alpha_m$=

$$V_n = \int_{-A_N}^{A_N} d\,x_N \int_{-\alpha_{N-1}}^{+\alpha_{N-1}} \int_{A_{N-1}}^{A_{N-1}} d\,X_{N-1} \ldots \int_{-\alpha_1 A_1}^{+\alpha_1 A_1} d\,X_1 \tag{11}$$

with $$\alpha_m = \sqrt{1 - \sum_{i=m+1}^{N} \left(\frac{X_i}{A_i}\right)^2} \tag{12}$$

and the equation of its surface is defined by the relation:

$$\sum_{1=i}^{n} \left(\frac{X_i}{A_i}\right)^2 = 1 \tag{13}$$

Denoting by $V_{m(A)}$ the volume of a slice with m dimensions (m<or equal to N) of the ellipsoid, in which the $m^{th}$ coordinate lies between −A and +A, the latter is expressed by the relation:

$$V_m(A) = \int_{-A}^{A} d\,X_m \int_{-\beta_m, m-1(A)A_{m-1}}^{+\beta_m, m-1(A)A_{m-1}} d\,X_{m-1} \ldots \int_{-\beta_m, 1(A)A_1}^{+\beta_m, 1(A)A_1} d\,X_1 \tag{14}$$

Using the relation (14) it is easy to deduce a recurrence relation linking two volumes with consecutive dimensions, i.e.:

$$V_m(A) = \int_{-A}^{A} d\,X_m V_{m-1}\left(\frac{A_{m-1}}{A_m}\sqrt{A^2 - X_m^2}\right) \text{ with } V_1(A) = 2A \tag{15}$$

The number of points to be quantized can then be obtained from the above relations by considering for example that the quantization interval is equal to 1 and that the dimensions of the axes Ai are positive integers. This determination can be achieved by considering in succession the isolated points (dimension 0), the series of contiguous points (dimension 1), and then by iteratively computing the volumes of dimensions 2 . . . N-1.

A microprogram enabling this result to be obtained is given in Appendix 1.

The quantization algorithm according to the invention is deduced from the abovementioned example in 3 dimensions. This algorithm consists in accumulating in the code value the number of points encountered on starting from a minimum value of the coordinates so as to arrive at the code value of the point considered. To perform this processing operation, the actual values of the coordinates $X_i$ are firstly converted into their nearest integer value. The resulting values are then corrected so as to be certain that the corresponding point does indeed lie inside the ellipsoid, since for any points which may be outside, it is supposed that the quantization error may be larger than that obtained for the points inside. An optimum procedure for processing these points would be to find the points which seem to be nearest to the interior of the ellipse. However, with the exception of a quantizing of points inside a sphere, there is unfortunately no simple process for performing this processing operation. A suboptimum algorithm for placing these points iteratively inside the ellipsoid by modifying their successive coordinates is as follows:

```
R=A_N
FOR n=N DOWN TO 1
  IF X_n>R THEN X_n=R
    ELSE IF X_n<-R THEN X_n=-R
  R=(A_n-1/A_n) (R^2-X_n^2)½
END FOR
```

In practice the instructions of the above algorithm have to be incorporated into the microprogram for the coding proper by using the volumes $V_n$ (A) already computed. This algorithm involves accumulating, in the final code, the number of points left behind the coded point with coordinates ($X_1$ . . . $X_N$) when starting from a point with coordinates (0, 0 . . . 0, $A_N$) on the surface of the ellipse and descending toward the point to be quantized. A microprogram for executing this coding algorithm is given in Appendix 2.

Naturally the maximum execution time for the above algorithm can be shortened by virtue of the symmetries. Thus, if Code0 represents the code of the origin point with coordinates (00 . . . 0) and C represents the code value for the point with coordinates $X_1, \ldots, X_N$ the code corresponding to the symmetric point ($-X_1, \ldots, -X_N$) is exactly equal to 2* Code0-C. To take this into account, the above microprogram can be supplemented with the following instructions:

```
Inversion=FALSE
IF X_N>=0
  Inversion=TRUE
  FORi=1 TO N DO X_i=-X_i
END IF
IF Inversion THEN Code 2 Code0-Code
```

Figure 4:
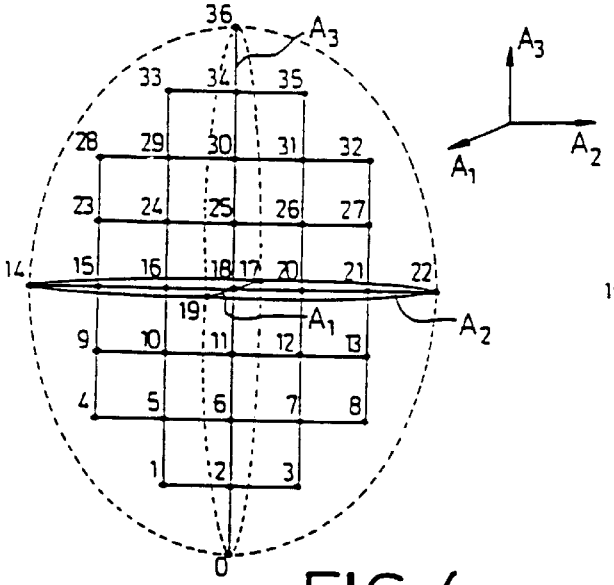
FIGS. 4 to 8*b*, example distributions of the coding of points in a three-dimensional space obtained by implementing the process according to the invention.
Figure 5:
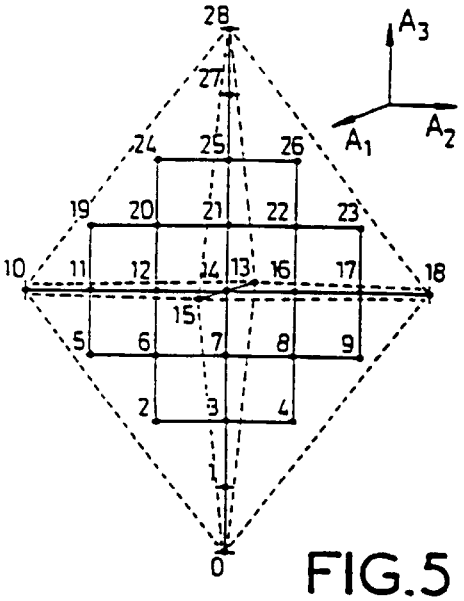

An example quantization is represented in FIG. 4 for the axis values $A_1$=1, $A_1$=3 and $A_1$=4. In this representation there are in total 37 centroids of elementary cubes and the barycentre of the ellipsoid corresponds to the code 18. For comparison, an example of an equivalent pyramid quantization is represented in FIG. 5. In this case the barycentre corresponds to the code 14.

The dequantization algorithm proceeds by seeking to reconstruct the terms which were added to give the value of the code, knowing that this reconstruction is by nature unique.

A corresponding microprogram is given in Appendix 3.

Figure 6:
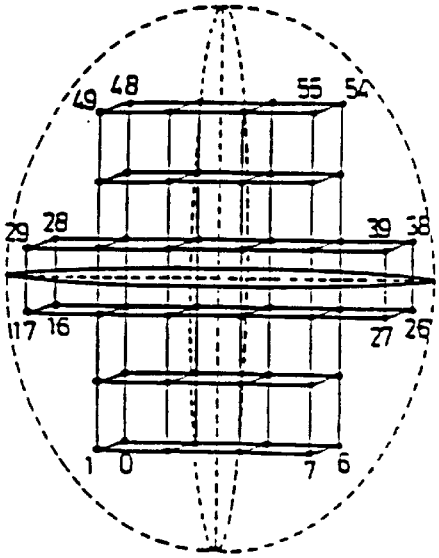

In order to account for certain situations in which it may be of interest to displace the origin of the set of centroids, the above algorithms may again be modified by considering half-integer rather than integer coordinates. A first possibility can consist in making a quantizer whose axes are twice the dimension of the axes A, required. A vector of N actual values can then be quantized after doubling, using odd integers only. The above algorithm can then be used, the output code obtained being converted by a table giving the final code. This transcoding is necessary for the reason that although only around a quarter of the original centroids need to be considered, this reduction does not correspondingly ease the execution of the algorithm. This is because, as FIG. 6 shows, with axis dimensions $A_1$=1, $A_2$=3, $A_3$=4, an extended ellipsoid of dimensions 2, 6 and 8 is then obtained which contains 369 centroids, this being very substantial compared with the 56 centroids of the ellipsoid devised with half-integer coordinates.

A second possibility can consist in modifying the initialization of the algorithm, the coding and the decoding in such a way as to use even coordinates only. Corresponding modified microprograms are given in Appendix 4.

The codes are transmitted as binary words. However, since a priori there is no particular reason why the number of points lying inside an ellipsoid should form an exact power of two, it appears highly desirable in order to use an optimal number of bits in the formation of the code, that this number be as close as possible to an exact power of two. This can be obtained by adjusting the volume of the ellipsoid by fractional rather than integer axis lengths.

In order to simplify the account, it will be assumed that the fractions representing the axes A, have a common denominator. In practice, the denominator values 1, 2, 3 are sufficient to obtain without difficulty ellipsoids containing a number of centroids as near as possible to an exact power of two.

For example, by considering in dimension 4 an ellipsoid of dimensions (3, 4, 5, 6), the latter contains exactly 1765 points. This number lies exactly between 1024 and 2048. By modifying these dimensions in the ratios (9/3, 13/3, 15/3, 19/3) this number is changed by the number 2025 which is 98.87% close to 2048 and may be said to represent an equivalent binary loss of log.2(0.9887)=0.016 bits. The difference 2048−2025=23 codes lost can then be used for coding particular configurations if necessary.

Consequently, the above algorithms may again be modified by considering axis lengths of the form ($A_1$/D, $A_2$/D, . . . , $A_N$/D) where D is a common denominator of small value. High values of D are not necessary since in practice, it is always possible to obtain good coding with D=1, 2 or 3.

The introduction of a common denominator leads to the following processing operations being performed:

1—definition of the axes:

$$a_i = A_i/D \quad i=1 \ldots N \tag{16}$$

2—equation of the ellipsoid (K=2) of the pyramid (K=1):

$$\sum_{i=1}^{N}\left(\frac{X_i}{a_i}\right)^K = D^K \sum_{i=1}^{N}\frac{X_i^K}{A_i^K} \le 1 \tag{17}$$

3—maximum value of $X_n$ $$\frac{X_n^K}{a_n^K} + \sum_{i=n+1}^{N}\frac{X_i^K}{a_i^K} \le 1 \tag{18}$$

$$i.e.\quad D^K X_n^K \le A_n^K\left(1 - D^K \sum_{i=n+1}^{N}\frac{X_i^K}{A_i^K}\right)$$

4—By reducing to the same denominator and keeping only the numerators, the following recurrence formulae are defined:

$$Den_n X_n^K \le Num_n \quad \text{with}$$

$$Den_N = D^K$$

$$Den_n = A_{n+1}^K Den_{n+1} = D^K \prod_{i=n+1}^{N} A_i^K, \quad n = N-1, N-2, \ldots, 1$$

$$Num_N = A_N^K$$

-continued $$Num_n = A_n^K (Num_{n+1} - Den_{n+1} X_{n+1}^K),\ n = N-1,\ N-2,\ \ldots,\ 1$$

The above relations show that if D is different from 1 or if the axes $A_i$ do not have small dimensions or if the dimensions N are large, a large number of points must be computed and that this computation must be performed in multiprecision arithmetic. The maximum value of $X_n$ is exactly $(Num_n/Den_n)^{1/2}$, and this value is almost never an integer, and therefore it is impossible to use the arrays such as $V_n(X_n)$ when programming. In practice, this problem can be solved by using two arrays, one array for the volumes and one array of values corresponding to the numerator since the denominators do not change. In this way, access to a specified volume may be achieved through the numerator corresponding to that sought. To reduce the computation time the numerators are stored in ascending order together with their corresponding volume. The initialization, coding and decoding microprograms are then modified in the manner represented in Appendix 5.

Another possibility consists in considering only the centroids for which the sum of the coordinates is even or odd. This amounts to keeping only half the original centroids, the latter being distributed over the original grid with origin DN here denoted $D_{n0}$ where its complement $D_{n1}$ which does not include the origin.

The main advantage of proceeding in this way is that it makes it possible to decrease the average quantization error by −0.25 db if N=3 where by around −0.4 db for N=4 to 10. This leads to modifying the initial quantization algorithm by considering only the points with even or odd coordinates respectively. Under these conditions the quantization algorithm consists in quantizing the points as before by searching for the nearest integer values of each coordinate and in modifying the integer coordinates which are most distant from their actual original value. However, the coding and decoding are then slightly more complex than for a grid of points having integer coordinates.

This is because two sets of volumes have to be found for dimensions 1 to N-1, a first set $V_{0,n(A)}$ of n-dimensional volumes having an odd sum of coordinates to a second set $V_{1n}(A)$ of volumes of dimension n having an even sum of coordinates. Under these conditions the computation of the volumes takes place in the manner described by the microprogram of Appendix 6.

Figure 7A:
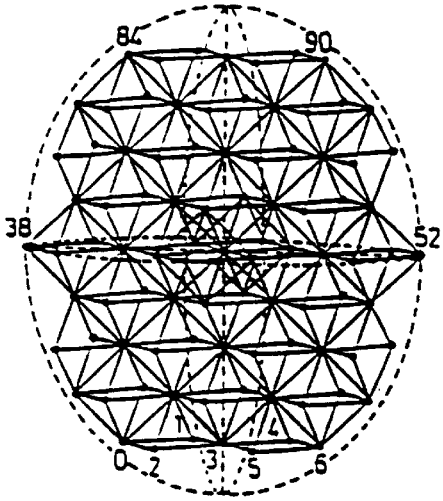
Figure 7B:
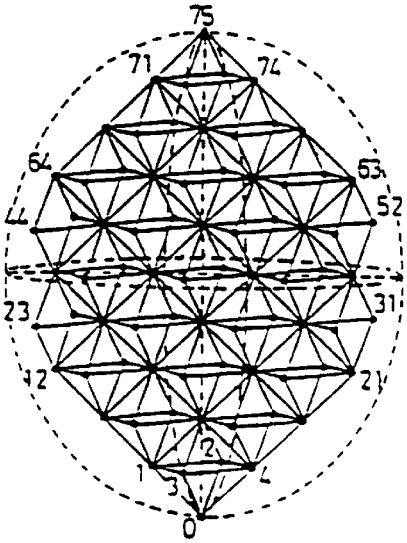

An example of ellipsoidal vector quantization for $D_{3,0}$ and $D_{3,1}$ is represented in FIGS. 7*a* and 7*b*. In this representation, the three axes have dimensions 2, 4, 5 respectively, that is to say they are slightly larger than those of the earlier examples in order to obtain a sufficient number of points. Each centroid is joined to its nearest neighbours in the same way as in FIGS. 4 and 6. It can be verified in these figures that the barycentre belongs (FIG. 7*a*) or does not belong (FIG. 7*b*) to the set of centroids.

Figure 8A:
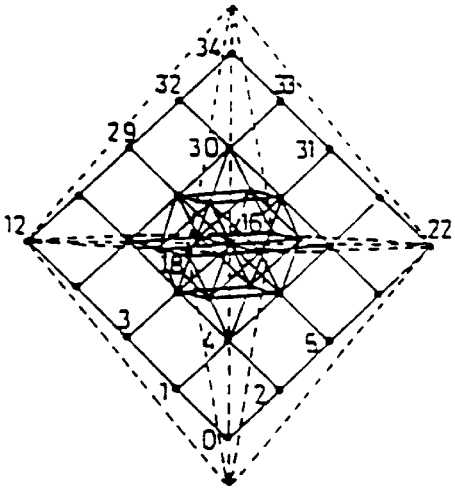
Figure 8B:
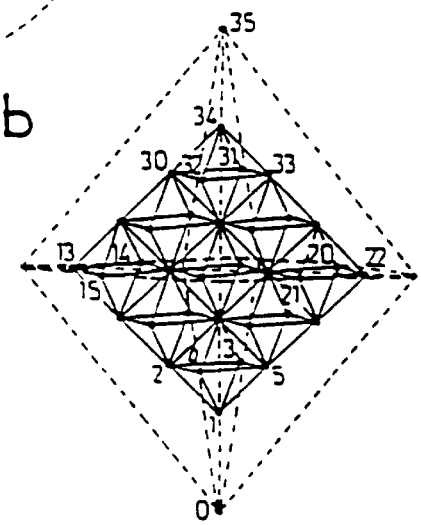

A generalization of the process to a pyramid quantization is also represented in FIGS. 8*a* and 8*b*.

APPENDICES

Appendix 1

```
1. For the isolated points
        V_o(0)=1
2. For the series of contiguous points of dimension 1
        FOR A + 0 TO A_1 D0 V_1(A) = 2*A+1
3. For the volumes with dimensions 2, . . . , N−1
FOR n = 2 TO N-1
        FOR A = 0 TO A_nXX
            V_n(A) = 0
            FOR X_n = 0 TO A
                X_n−1 = (A_n−1/A_n) (A^2 − X_n^2)^1/2
                IF X_n = 0      THEN V_n(A) = V_n−1(X_n−1)
                                ELSE V_n(A) = V_n(A) + 2*V_n−1(X_n−1)
          END FOR
        END FOR
END FOR
```

Appendix 2

```
Code = 0
R = A_N
FOR n = N DOWN TO 1
        IF X_n> −R
            FOR X = −R TO X_n−1
                Y = INT ((A_n−1/A_n)(R^2 − X^2)^1/2)
                Code = Code + V_n−1(Y)
            END FOR
        END IF
        R = (A_n−1/A_n) (R^2 − X_n^2)^1/2
END FOR
```

Appendix 3

```
R = A_N
FOR n = N DOWN TO 1
        X_n = -R
        Y = INT ((A_n−1/A_n)(R^2 − X_n^2)^1/2)
        WHILE Code >=V_n−1(Y)
        Code = Code − V_n−1(Y)
        X_n − Xn + 1
        Y = INT ((A_n−1/A_n)(R^2 − X_n^2)^1/2)
        END WHILE
        R = Y
END FOR
```

An improvement to the speed of execution of this microprogram can also be obtained by introducing the following instructions:

-continued

APPENDICES

```
Inversion = FALSE
IF Code>Code 0
        Inversion = TRUE
        Code = 2 Code 0 - Code
END IF
(decoding giving X_i)
IF Inversion THEN FOR i = 1 TO N DO X_i = -X_i
Appendix 4
FOR A = 0 TO A_1 DO V_1(A) = 2 INT((A+1)/2)
FOR n = 2 TO N-1
        FOR A = 0 TO A_n
            V_n(A) = 0
            FOR X_n = 0 TO INT((A - 1)/2)
                X_n = 2 X_n + 1
                X_{n-1} = INT(((A_{n-1}/A_n)(A^2 - X_n^2)^{1/2}-1)/2)
                X_{n-1} = 2 X_{n-1} + 1
                V_n(A) = V_n(A) + 2 V_{n-1}(X_{n-1})
            END FOR
        END FOR
END FOR
Modification of the coding
Code = 0
R = A_N
FOR n = N DOWN TO 1
        X_n = INT((X_n - 1)/2);
        r = INT((R - 1)/2)
        IF X_n>-r
            FOR x = -r TO X_{n-1}
                X = 2 x + 1
                y = INT(((A_{n-1}/A_n)(R^2-X^2)^{1/2}-1)/2)
                Y = 2 y + 1
                Code = Code + V_{n-1}(Y)
            END FOR
        END IF
        R = (A_{n-1}/A_n)(R^2 - X_n^2)^{1/2}
Modification of the decoding.
R = A_N
FOR n = N DOWN TO 1
        X_n = -2 INT((R - 1)/2) - 1
        y = INT (((A_{n-1}/A_n)(R^2 - X_n^2)^{1/2} - 1)/2
        Y = 2 y + 1
        WHILE Code >=V_{n-1}(Y)
            Code = Code - V_{n-1}(Y)
            X_n = X_n + 2
            y = 2 INT(((A_{n-1}/A_n)(R^2 - X_n^2)^{1/2}-1)/2
            Y = 2 y + 1
        END WHILE
        R = Y
END FOR
Appendix 5
Initialisation: computation of the volumes and numerators
        Den_{N-1} = D^2
        FOR i=N-2 DOWN TO 0 DO Den_{i+1}=Den_{i+1}.A_{i+1}^2 Precomputed
denominators
Computation of the volumes (dimensions 2 . . . N-1 only)
(Z)     FOR 1 = 1 TO N-2 DO NV_{i-1} = 0
(D)     FOR 1 = 1 TO N-2 DO NV_{o,i-1} = 0
        Mult_{n-1} = D
        FOR 1 = N-2 DOWN TO 0 DO Mult_i=Mult_{i+1} A_{i+1}
        XMax_{N-1}=A_{N-1}/D integer division
        maxCode = -1
        Num_{N-1} = 1
        n = N
(D)     Sum_n=0  Sum of the previous coordinates
New Dimension
            n = n - 1
        Xmax_{n-1}= 0
        X_n = -XMax_n - 1
        InitialNum_n = Num_n A_n^2
        previous V_n = maxCode call to the last final value
Increase coordinate
        X_n = X_n + 1
(D)     Sum_n = Sum_{n+1} + X_n
(D)     p = REM2(Sum_n)  current parity
        Num_{n-1} = initialNum_n - Mult_n^2 X_n^2
        ANum_{n-1} = Num_{n-1} A_{n-1}^2
        IF X_n <= 0
            WHILE Den_{n-1} XMax_{n-1}^2 < Anum_{n-1} DO
```

-continued

APPENDICES

```
        WHILE Den_{n-1} XMax_{n-1}^2>ANum_{n-1} DO XMax_{n-1} = XMax_{n-1}^{-1}
        IF n > GOTO nextDimension
(Z)     maxCode = maxCode+(1+2 XMax_o)
(D)     IF p = Parity THEN maxCode = max Code +1+2 INT(XMax_o/2)
(D)         ELSE maxCode = maxCode + 2 INT((XMax_o+1)/2)
Test of coordinate
        IF X_n<XMax_n GOTO increaseCoordinate
        IF n = N-1 THEN END
        vol = maxCode - previousV_n
Keep the max values of Num in ascending order, with their associated
value V
(D)     IF Sum_{n+1}=2INT(Sum_{n+1}/2)THEN p=0 ELSE p=1 current parity
(Z/D)   IF NV_{n-1} = 0 first volume of this dimension.
(Z/D)       NV_{n-1}=1
(Z/D)       maxNumer_{n-1,1}= Num_n
(Z/D)       V_{n-1} = vol
        ELSE        this is not the first volume: test the order
(Z/D)       M = NV_{n-1}
            FOR i = NV_{n-1} - 1 DOWN TO 0
(Z/D)           IF vol = V_{n-1,i}
(Z/D)               IF Num_n>maxNumer_{n-1,i}
(Z/D)                   maxNumer_{n-1,1}= Num_n
                GOTO numerFound
                END IF
(Z/D)           If vol<V_{n-1,i} THEN M = i
            END FOR
            END FOR
(Z/D)   IF M <= Nv_{n-1} modify maxNumer and V
(Z/D)           FOR - = NV_{n-1} DOWN TO M+1
(Z/D)               maxNumer_{n-1,i} = maxNumer_{n-1,i-1}
(Z/D)               V_{n-1,i} = V_{n-1,i-1}
            END FOR
        END IF
(Z/D)   maxNumer_{n-1,M} = Num_n
(Z/D)   V_{n-1,M} = vol
(Z/D)   NV_{n-1} = NV_{n-1} + 1
        END IF
number found
        n = n + 1
        GOTO testCoordinate
B. Coding algorithm (the x_i are assumed to be correct).
        Code = 0
        R = A_{N-1}
        Num = 1
        Mult = D
(D)     Sum_n = 0 sum of the previous coordinates
        FOR n = N - 1 DOWN TO 1 Loop over the dimensions
            R_O = 0
            initialNum = Num A_N^2
If the p^th coordinate is greater than the minimum R, add volumes
corresponding to -R, -R+1, . . . X_n-1 to the code
            IF X_n> -R
                FOR iX = -R TO X_{n-1}
                    Num = initialNum - Mult^2iX^2
(D)                 Sum_n = Sum_{n-1}+iX
                    p = REM2(Sum_n) current parity
                      IF n>1 Si n>1, the volumes can be accessed
through the                     value of Num
                        i = 1
(Z/D)                   WHILE Num>maxNumer_{n-1,i} DO i = i + 1
(Z/D)                   Code = Code + V_{n-1,i}
                    ELSE If n=1, the volumes are computed
                      ANum = Num A_o2
                      IF iX <= 0
                            WHILE Den_o R_o ^2<ANum DO R_o=R_o+1
                      WHILE Den_o R_o^2>ANum DO R_o=R_o-1
(Z)                         Code = Code + 1 + 2*R_o
(D)                         IF p = parity THEN Code=Code+1+2INT(R_o/2)
(D)                                 ELSE Code=Code+2INT((R_o+1)/2)
                        END IF
                END FOR
            END IF
(D)         Sum_n = Sum_{n+1} + X_n
If necessary, compute R for the next dimension
        Num = initialNum - Mult^2X_n^2
        Anum = Num A_{n-1}2
        IF n>1          if n>1, iterative computation
            R = 0
```

-continued

APPENDICES

```
            WHILE Den_{n-1} R^2<ANum DO R = R+1
            IF Den_{n-1} R^2>ANum THEN R=R -1
            Mult = Mult A_n
        ELSE  if n = 1 the next dimension is 1
Adjust R taking into account the fact that it can only increase if X_1≦0 and
decrease if X_1<0
            R = R_o
            IF X_1<= 0
                        WHILE Den_oR^2 < ANum DO R = R + 1
            WHILE Den_o R^2>ANum DO R = R-1
(Z)     Code = Code + X_o + R Final adjustment of the code
(D)     IF X_o> -R
(D)                     FOR i = -R TO X_o-1
(D)                         IF REM2 (Sum_1+i) = Parity
(D)     END IF
(D)     END FOR
C. Decoding algorithm
        R = A_{N-1}/D integer division
        Num = 1
        Mult = D
(D) Sum_n of the previous coordinates
        FOR n = N - 1 DOWN TO 1 Loop over the dimensions
If the n^th coordinate X[n] is greater than its minimum, R, the code contains
the sum of the n-dimensional volumes corresponding to -R, -R+1, . . . X_n-1
            R_o = 0
            initialNum Num A_n^2
            X_n = -R
            Num = initialNum - Mult^2X_n^2
(D)         p = REM2(Sum_{n+1}+ X_n)
Trial subtraction of volumes to form the code
            IF n>1 These volumes are tabulated for n>1, as being a
            function of Num
                i = 1
(Z/D)       WHILE Num>maxNumer_{n,i} DO i = i + 1
(Z/D)       WHILE Code>=V_{n,i}
(Z/D)           Code = Code - V_{n,i}
                X_n = X_n + 1
(D)             P = 1 - P
                Num = initial Num - Mult^2X_n^2
                i = 1
(Z/D)           WHILE Num > maxNumer_{n,i} DO i = i + 1
            END WHILE
        ELSE            If n = 1, the volumes are almost easy to
compute . . .
            ANum = Num A_o^2
            IF X_n <=0
                WHILE Den_o R_o^2<ANum DO R_o = R_o + 1
            WHILE Den_o R_o^2>ANum DO R_o = R_o - 1
(Z)         length = 1 + 2 R_o
(D)         IF p = Parity THEN length = 1 + 2 INT(R_o/2)
(D)                 ELSE length = 2 INT((R_o + 1)/2)
            WHILE Code>= length
                Code = Code - length
                X_n = X_n + 1
(D)             p = 1 - p change the parity
                Num = initialNum - Mult^2X_n^2
                ANum = Num A_o^2
                IF X_n <= 0
                        WHILE Den_o R_o^2<ANum DO R_o = R_o + 1
                WHILE Den_o R_o^2>ANum DO R_o = R_o - 1
(Z)         length = 1 + 2 R_o
(D)       IF p = Parity THEN length = 1 + 2 INT(R_o/2)
        ELSE length = 2 INT((R_o+1/2)
        END WHILE
        END IF
If necessary, compute R for the next dimension.
        ANum = Num A_{n-1}^2
(D)     Sum_n = Sum_{n+1}+ X_n
        IF n>1 if n>1, iterative computation
          R = 0
          WHILE Den_{n-1} R^2<ANum DO R = R+1
          IF Den_{n-1} R^2>ANum THEN R = R - 1
          Mult = Mult A_n^2
        ELSE If n-1, the next dimension is 1
Adjust R taking into account the fact that it can only increase if X1< = 0,
and decrease if X_1>0
          R = R_o
          IF X_1<=0
```

-continued

APPENDICES

```
            WHILE Den_o R^2<ANum DO R = R + 1
          WHILE Den_o R^2>ANum DO R = R − 1
(Z)       X_o = −R Last coordinate code. . .
(D)       p = Sum_1 − 2 INT(Sum_1/2)
(D)       X_o = −R + 2 Last coordinate code
(D)       p_o = REM2(X_o) parity of X_o
(D)       IF Parity = 0
(D)         IF p_o<>p THEN X_o=X_o+1
(D)       ELSE
            IF p_o=p THEN X_o=X_o+1
(D)       END IF
        END IF
        END FOR
```

NB: The instructions labelled (Z) are those to be used when the axes have integer lengths. The instructions labelled (D) relate to grids of points having coordinates with even and odd sums. For the instructions labelled (Z/D), $NV_{a,b}$ is replaced by $NV_{p,a,b}$, $V_{a,b}$ by $V_{p,a,b}$ and $maxNumer_{a,b}$ is replaced by $maxNumer_{p,a,b}$ if the current grid is $D_{n0}$ or $D_{n-1}$. For $D_n$, the variable parity is 0 for $D_{n0}$ and 1 for $D_{n1}$. The function REM2(X) computes the remainder when X is divided by 2: it is equivalent to X − 2 INT(X/2).

Appendix 6

```
First dimension
FOR A = 0 TO A_1 STEP 2 DO V_0,1(A)=A+1
FOR A = 1 TO A_1 STEP 2 DO V_1,1(A)=A+1
Dimensions 2 . . . N−1:
FOR n = 2 TO N−1
        FOR A = 0 TO A_n
            V_0,n(A)=0
            V_1,n(A)=0
            FOR X_n=0 TO A
                X_n−1=(A_n−1/A_n) (A^2−X_n^2)1/2
                IF X_n = 2 INT(X_n/2)
                    IF X_n = 0
                        V_0,n(A) = V_0,n−1(X_n−1)
                        V_1,n(A) = V_1,n−1(X_n−1)
                    ELSE
                        V_0,n(A) = V_0,n(A) + 2*V_0,n−1)(X_n−1)
                        V_1,n(A) = V_1,n(A) + 2*V_1,n−1)(X_n−1)
                    END IF
                ELSE
                        V_0,n(A) = V_0,n(A) + 2*V_1,n−1)(X_n−1)
                        V_1,n(A) = V_1,n(A) ++00 2*V_0,n−1)(X_n−1)
                ENDIF
            END FOR
        END FOR
END FOR
```

I claim:

1. A process for the vector quantization of low bit rate vocoders, comprising:

determining a coding region by surrounding with an envelope a scatter of points of an autocorrelation matrix of reflection coefficients of a filter configured to model a vocal tract, wherein the envelope has a shape selected from the group consisting of a hyperellipsoid shape and a pyramidal shape, the envelope being centered at the barycentre of the scatter of points;

determining principal axes of the volume of points inside the envelope;

projecting area coefficients of the autocorrelation matrix onto the principal axes;

partitioning the interior volume of the envelope into elementary volumes; and coding partition coefficients resulting from partitioning the interior volume on the basis of coordinates of said partition coefficients in a space defined by the principal axes of the volume of the points inside the envelope, while allocating as code values only values corresponding to locations of the elementary volumes in which said partition coefficients lie.

2. The process according to claim 1, wherein partitioning the interior volume of the envelope comprises partitioning said volume into slices perpendicular to a first principal axis direction from a first end slice to a slice preceding a last slice containing a point to be coded, and further comprising:

accumulating the numbers of points contained in each successive slice; and adding to the number of points obtained the number of points remaining in the last slice so as to arrive at the point to be coded.

3. The process according to claim 2, further comprising converting actual values of the coordinates of the points to be coded into a nearest integer value.

4. The process according to claim 2, wherein coding the partition coefficients comprises considering only half-integer coordinates.

5. The process according to claim 2, wherein coding the partition coefficients comprises considering only coordinates with one of even and odd sums.

6. The process according to claim 2, wherein the envelope surrounding the scatter of points has a hyperellipsoid shape.

7. The process according to claim 2, wherein the envelope surrounding the scatter of points has a pyramidal shape.

8. The process according to claim 2, further comprising adjusting the interior volume of the envelope by fractional coordinate axis lengths.

9. The process according to claim 1, wherein the envelope surrounding the scatter of points has a hyperellipsoid shape.

10. The process according to claim 9, further comprising converting actual values of the coordinates of the points to be coded into a nearest integer value.

11. The process according to claim 9, wherein coding the partition coefficients comprises considering only half-integer coordinates.

12. The process according to claim 9, wherein coding the partition coefficients comprises considering only coordinates with one of even and odd sums.

13. The process according to claim 9, further comprising adjusting the interior volume of the envelope by fractional coordinate axis lengths.

14. The process according to claim 1, wherein the envelope surrounding the scatter of points has a pyramidal shape.

15. The process according to claim 14, further comprising converting actual values of the coordinates of the points to be coded into a nearest integer value.

16. The process according to claim 14, wherein coding the partition coefficients comprises considering only half-integer coordinates.

17. The process according to claim 14, wherein coding the partition coefficients comprises considering only coordinates with one of even and odd sums.

18. The process according to claim 14, further comprising adjusting the interior volume of the envelope by fractional coordinate axis lengths.

19. The process according to claim 1, further comprising adjusting the interior volume of the envelope by fractional coordinate axis lengths.

20. The process according to claim 19, wherein the fractional axis lengths have a common denominator.

* * * * *